US005410929A

United States Patent [19]

Wallace

[11] Patent Number: 5,410,929

[45] Date of Patent: May 2, 1995

[54] DEVICE FOR RECYCLING A TUBE SUCH AS A CORE

[75] Inventor: Marcus T. Wallace, Smyrna, Tenn.

[73] Assignee: Fibercore Recycle Systems, Inc., Smyrna, Tenn.

[21] Appl. No.: 64,820

[22] Filed: May 19, 1993

[51] Int. Cl.[6] ..... B26D 1/09

[52] U.S. Cl. ..... 83/160; 83/620; 83/706; 241/263; 241/283

[58] Field of Search ..... 83/620, 44, 45, 47, 83/906, 160, 167; 241/283, 263, 291, DIG. 38

[56] References Cited

U.S. PATENT DOCUMENTS

| | | | |
|---|---|---|---|
| 582,689 | 5/1987 | Riehl | 241/283 |
| 2,297,177 | 9/1942 | Tiffany | 83/620 |
| 3,777,606 | 12/1973 | Goldstein | 83/620 X |
| 4,139,134 | 2/1979 | Collins | 83/906 X |
| 4,926,729 | 5/1990 | Igarashi | 83/372 X |

*Primary Examiner*—Kenneth E. Peterson

*Attorney, Agent, or Firm*—Waddey & Patterson; Mark J. Patterson

[57] ABSTRACT

The present invention discloses a device for recycling a tube such as a core having housing which has an upper side, a lower side, and a first side. Attached to the upper side is an input chute. The input chute receives the core. The bottom end of the core is fed into a traveling horizontal blade as well as a splitter blade. The travelling horizontal blade makes a horizontal cut proximate to the lower end of the core whereas the splitter blade makes a cut proximate to the lower or distal end of the core in a vertical direction. The same piston that pushes the splitter blade and traveling blade into the core then pushes the core into a stationary blade which makes another horizontal cut and separates a piece from the core which then drops into a storage area. The same piston which pushes the splitter blade and traveling blade can then push the pieces in the storage area toward a discharge chute. When the piston is extended such that the core has been pushed into the stationary blade, a switch is activated to retract the piston.

28 Claims, 4 Drawing Sheets

DEVICE FOR RECYCLING A TUBE SUCH AS A CORE

BACKGROUND OF THE INVENTION

The present invention relates generally to a device for recycling a tube such as a core and more particularly to a device for cutting a tube such as a core into small pieces which can then be recycled.

It will be appreciated by those skilled in the art that rolls such as paper rolls used in printing are wrapped around a core which is usually tubular in shape. It will further be appreciated by those skilled in the art that these tubes are usually made of some type of cardboard or rubber. These cores are usually not reused. As a result, these cores must be either recycled or thrown away. Unfortunately, these cores as a whole can not be recycled effectively.

What is needed, then, is a device for recycling a tube such as a core. This needed device must be capable of cutting a core into small pieces which can then be recycled. This device must be mechanically simple and reasonably priced to manufacture. This device must be safe. This device is presently lacking in the prior art.

SUMMARY OF THE INVENTION

The present invention discloses a device for recycling a tube such as a core having housing which has an upper side, a lower side, and a first side. Attached to the upper side is an input chute. The input chute receives the core. The bottom end of the core is fed into a traveling horizontal blade as well as a splitter blade. The travelling horizontal blade makes a horizontal cut proximate to the lower end of the core whereas the splitter blade makes a cut proximate to the lower or distal end of the core in a vertical direction. The same piston that pushes the splitter blade and traveling blade into the core then pushes the core into a stationary blade which makes another horizontal cut and separates a piece from the core which then drops into a storage area. The same piston which pushes the splitter blade and traveling blade can then push the pieces in the storage area toward a discharge chute. When the piston is extended such that the core has been pushed into the stationary blade, a switch is activated to retract the piston.

Accordingly, one object of the present invention is to provide a device for recycling a tube such as a core.

Still a further object of the present invention is to provide a device which can cut a tube into small pieces.

Still a further object of the present invention is to provide a device which is mechanically simple to make as well as reasonably priced.

A further object of the present invention is to provide a device which is safe.

DESCRIPTION OF THE PREFERRED EMBODIMENT

Figure 1:
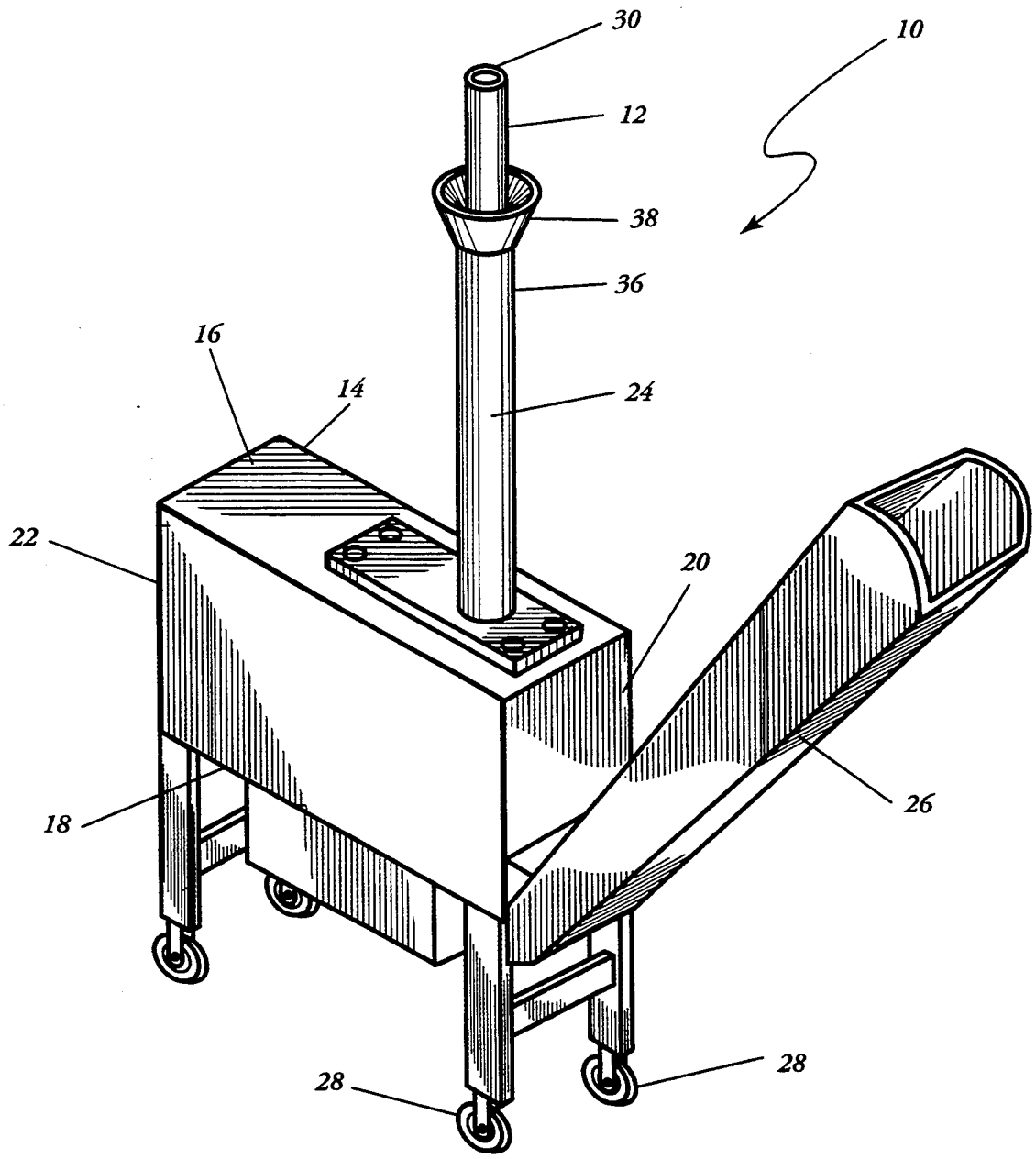
FIG. 1 is a perspective view of the device of the present invention.

Referring now to FIG. 1 there is shown generally at 10 the device for recycling a tube such as a core. Device 10 has housing 14 having upper side 16, lower side 18, first side 20, and second side 22. Attached to upper side 16 is input chute 24 which, as will be disclosed later, slides horizontally along upper side 16. Proximate to first side 20 is placed output chute 26. Device 10 can be placed on wheels 28 for easy movement. Core 12 is placed within input chute 24. Core 12 has proximal end 30 and distal end (32 in FIG. 2). Input chute 24 has lower end (34 in FIG. 2) and upper end 36. Funnel 38 can be provided for easy placement of core 12 in input chute 24. In the preferred embodiment, funnel 38 is made of neoprene rubber so that as core 12 within input chute 24, user's fingers are not smashed.

Figure 2:
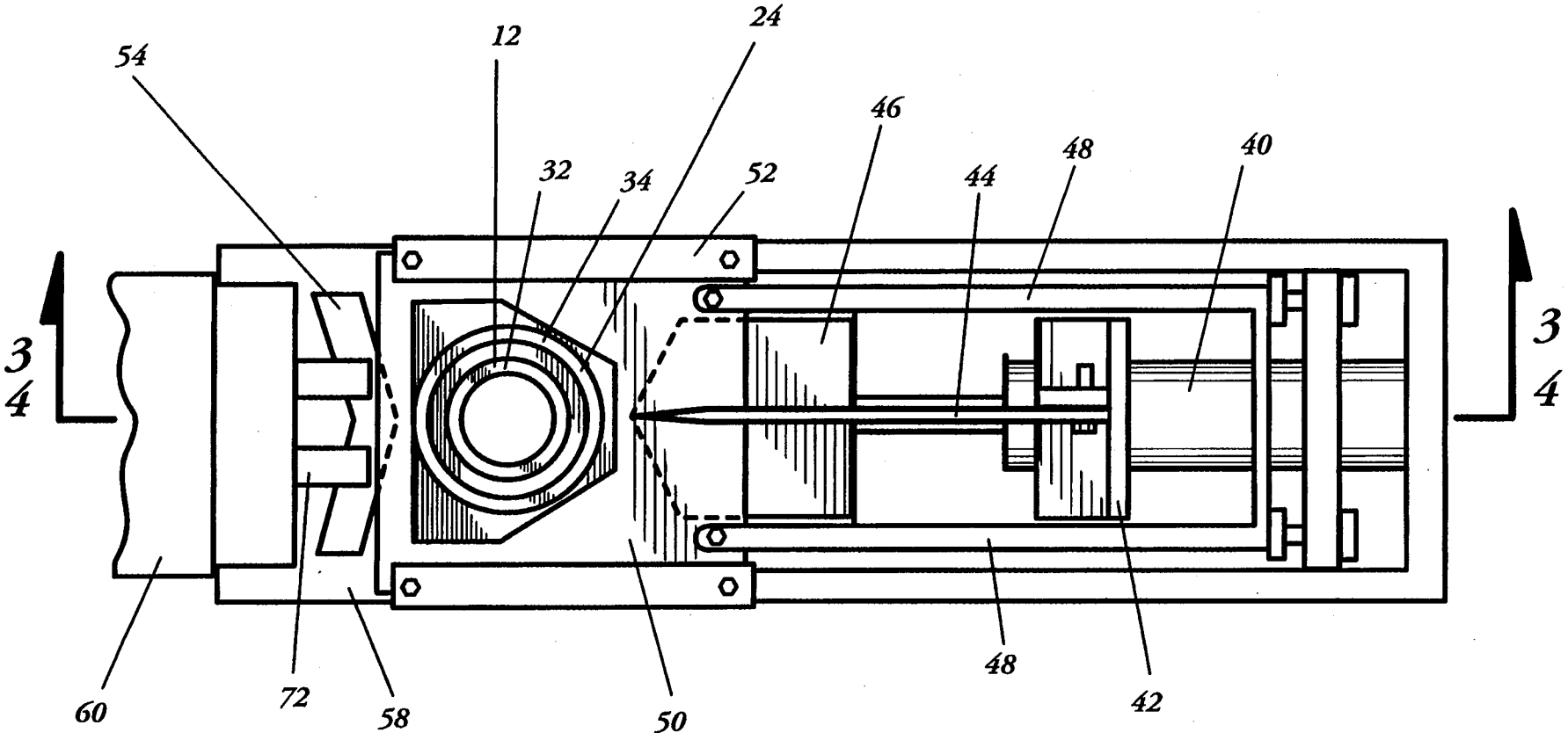
FIG. 2 is a cut-away plan view of the device of the present invention.

Referring now to FIG. 2 there is shown another view of the device of the present invention. As discussed with respect to FIG. 1, core 12 is placed within input chute 24. This particular view shows distal end 32 of core 12 and lower end 34 of input chute 24. Piston fully pushes ram 42 in a horizontal direction toward input chute 24. Concurrently, attached to ram 42 is splitter blade 44 and traveling blade 46. Traveling blade 46 is directed into core 12 proximate to distal end 32 to make a horizontal cut. Concurrently, splitter blade 44 is directing into core proximate to distal end but in a vertically disposed orientation to traveling blade 46 to make vertical cut in core 12. Generally, splitter blade 44 is aligned in a proximate perpendicular alignment to traveling blade 46. In the preferred embodiment, traveling blade 46 is generally wedged or V-shaped. Ram 42, splitter blade 44, and traveling blade 46 generally travel along draft backs 48. Meanwhile, plate 50 receives input chute 24 and slidably moves along rail 52. Therefore, after traveling blade 44 and splitter blade 46 pass into core 12, piston 40 continues to extend to push plate 50 along rail 52 such that core 12 is directed into stationary blade 54. Stationary blade 54 is in an proximate parallel alignment with traveling blade 46 and aligned, in the preferred embodiment, above traveling blade 46. Further, splitter blade 44 is placed so that it will pass, in the preferred embodiment, above stationary blade 54. Pieces (56 in FIG. 4) of core 12 which are cut away by blades 44, 46, and 54 then fall within storage area 58 until ram 42 pushes pieces 56 into discharge chute 60. Push backs 72 are provided adjacent to stationary blade 54 to provide a better cut of core 12 and control deformation.

Figure 3:
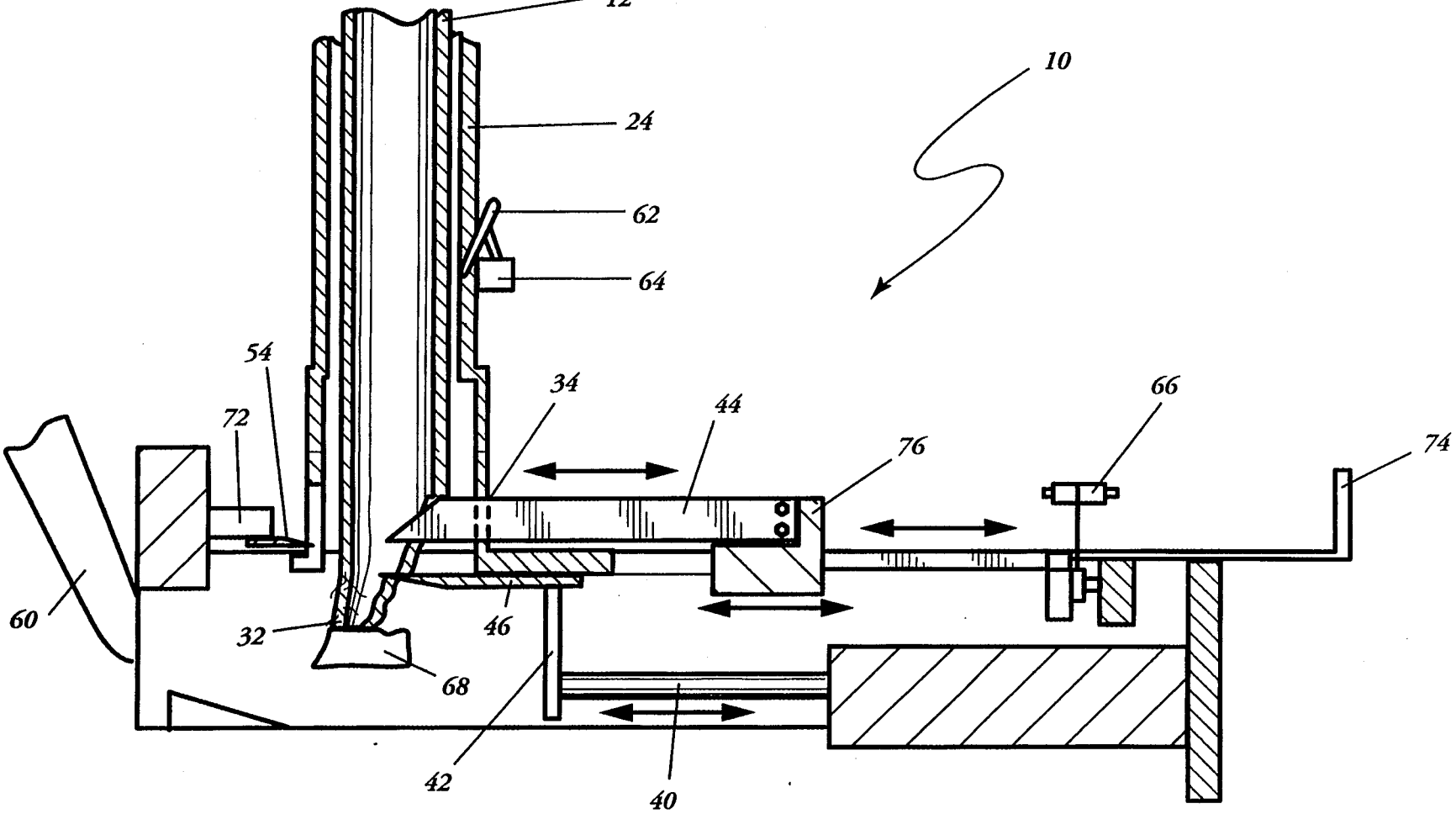
FIG. 3 is a side cut-away view of the device of the present invention showing the splitter blade and traveling blade engaging the core.

Referring now to FIG. 3 there is shown the first stage of movement of device 10 to cut pieces (56 in FIG. 4) away from distal end 32 of core 12. As stated above, core 12 is placed in input chute 24 such that distal end 32 of core 12 lies proximate to lower end 34 of core 12. Piston 40 pushes ram 42 in a general horizontal alignment such that splitter blade 44 and traveling blade 46 are pushed into core 12 proximate to distal end 32. Device 10 will only work with core 12 in input chute 24 because of safety switch 62 which is biased or spring loaded so that it is in the ON position only when input chute 24 is full. When input chute 24 is empty, switch 62 will be in an OFF position. As an additional safety feature, even if core 12 is in input chute 24, ON/OFF switch 64 can be turned ON or OFF by user. Splitter blade 44 makes an approximately vertical cut in core 12 proximate to distal end 32 as traveling blade 46 makes a horizontal cut. As core 12 is placed within input chute 24, distal end 32 resides on blocks 68.

Figure 4:
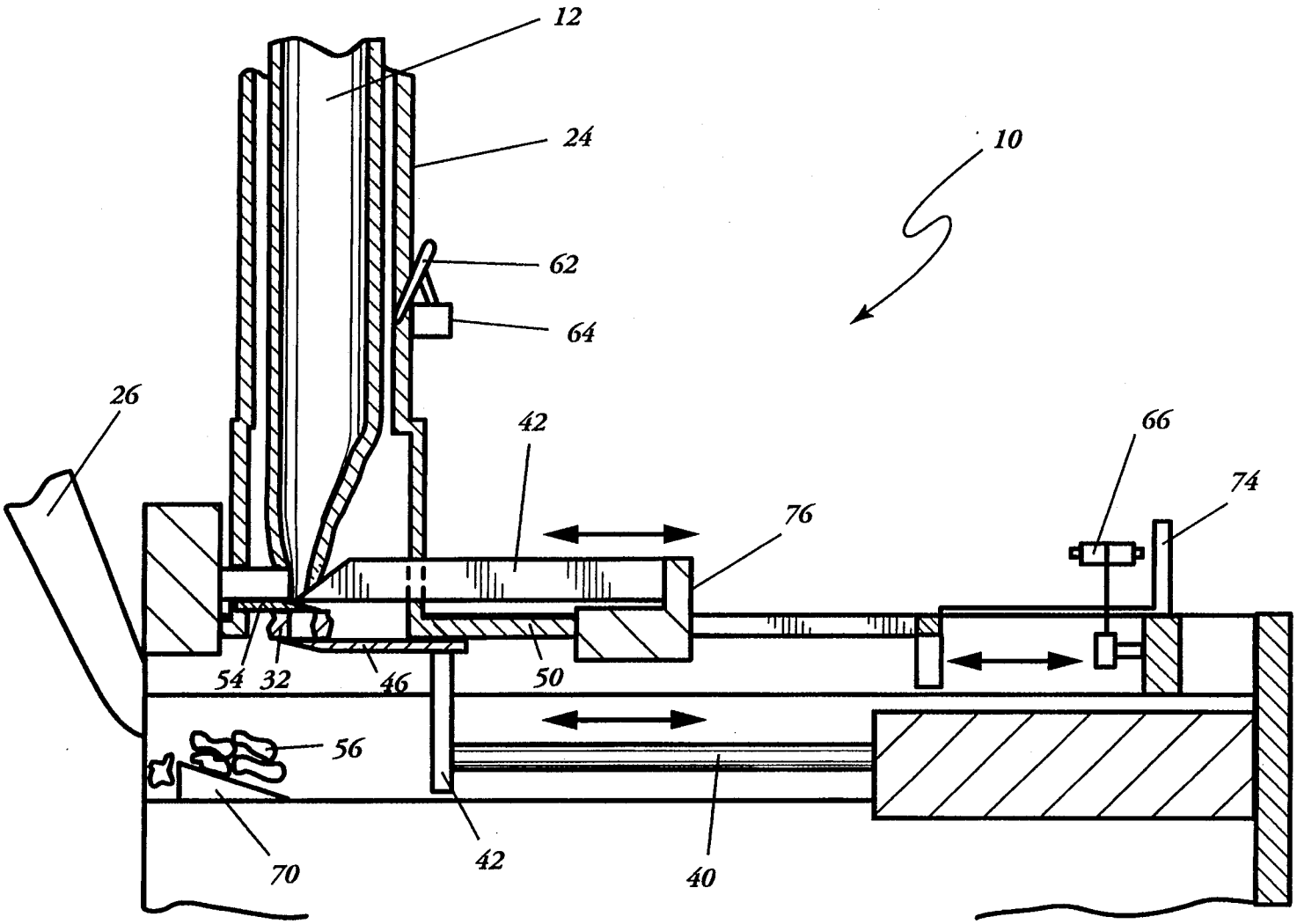
FIG. 4 is a side cut-away view of the device of the present invention showing the tube being engaged by the stationary blade.

Referring now to FIG. 4 there is shown the second sequential movement of device 10 of the present invention. FIG. 3 shows splitter blade 44 and traveling blade 46 engaging core 12 proximate to distal end 32. FIG. 4 shows piston 40 being extended further to push plate 50 and input chute 24 and therefore core 12 into stationary blade 54. As piston 40 is extended, ram 42 is pushed toward output chute 26 to direct pieces 56 in storage area 58 toward output chute 26. Back feed dogs 70 are provided to prevent pieces 56 from flowing away of output chute 26. Holes are placed into ram 42 so that it may pass over back feed dogs 70.

Referring now to FIGS. 3 and 4, when piston 40 extends to the desired length, which is when core 12 has been pushed into stationary blade 54, tell-it switch 66 is activated by drag back 74 which is dragged behind splitter blade 42. When tell-it switch 74 is activated, stroke of piston 40 is reversed. When piston 40 is retracted to sufficient length to allow distal end 32 of core 12 to pass below traveling blade 46, second drag back 76 activates tell-it switch 66 to again reverse stroke of piston 40. In the preferred embodiment, cycle time is eight seconds. However, the cycle time is not critical.

In the preferred embodiment, core 12 is of general tubular shape. This tubular shape can be round or square. Further, the tubing can be any type of material including, most popularly, cardboard or rubber. In the preferred embodiment, device 10 is designed for cores having diameters of two to four inches. However, and size can be cut be changing the diameter of input chute 24 and size of splitter blade 42.

Piston 40 is moved hydraulically.

Thus, although there have been described particular embodiments of the present invention of a new and useful device for recycling a tube such as a core, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for cutting a tubular core having a proximal and distal end into pieces, said device comprising:

a. a housing;

b. means attached to said housing for receiving said distal end of said tubular core;

c. means attached to said housing for splitting said tubular core proximate said distal end;

d. first means attached to said housing for cutting said distal end of said tubular core aligned approximately perpendicularly to said means for splitting said distal end of said tubular core; and e. second means attached to said housing for cutting said tubular core proximate said distal end aligned in approximate parallel alignment to said first means for cutting said distal end of said tubular core;

f. means attached to said housing for sequentially moving said first means attached for cutting said distal end of said tubular core and said means for splitting said distal end of said tubular core into said tubular core and then moving said means for receiving said distal end of said tubular core and said distal end of said tubular core into said second means for cutting said tubular core;

g. means attached to said housing for pushing said stored pieces toward said means for discharging said stored pieces.

2. The device of claim 1 wherein said means for receiving said distal end of said tubular core comprising an input chute having an upper and a lower end.

3. The device of claim 1 further comprising means attached to said housing for storing said pieces of said tubular core.

4. The device of claim 3 further comprising means attached to said housing for discharging said stored pieces.

5. The device of claim 3 wherein said means for storing said pieces of said tubular core comprises a storage area in said housing.

6. A device for cutting a tubular core having a proximal and distal end into pieces, said device comprising:

a. a housing;

b. means attached to said housing for receiving said distal end of said tubular core;

b. means attached to said housing for splitting said tubular core proximate said distal end;

c. first means attached to said housing for cutting said distal end of said tubular core aligned approximately perpendicularly to said means for splitting said distal end of said tubular core;

d. second means attached to said housing for cutting said tubular core proximate said distal end aligned in approximate parallel alignment to said first means for cutting said distal end of said tubular core;

e. means attached to said housing for discharging said stored pieces; and f. said device being powered by electricity;

g. means attached to said means for receiving said distal end of said tubular core for turning on said electricity only when a core in said means for receiving said distal end of said tubular core;

h. means attached to said housing for preventing said pieces from back-flowing.

7. The device of claim 6 wherein said means for turning on said electricity only when a core in said means for receiving said distal end of said tubular core comprises a safety switch.

8. A device for cutting a tubular core having a proximal and distal end into pieces, said device comprising:

a. a housing;

b. means attached to said housing for receiving said distal end of said tubular core;

b. means attached to said housing for splitting said tubular core proximate said distal end;

c. first means attached to said housing for cutting said distal end of said tubular core aligned approximately perpendicularly to said means for splitting said distal end of said tubular core;

d. second means attached to said housing for cutting said tubular core proximate said distal end aligned in approximate parallel alignment to said first means for cutting said distal end of said tubular core;

e. means attached to said housing for discharging said stored pieces; and f. means attached to said housing for pushing said stored pieces toward said means for discharging said stored pieces.

9. A device for cutting a tubular core having a proximal and distal end into pieces, said device comprising:
a. a housing;
b. means attached to said housing for receiving said distal end of said tubular core;
b. means attached to said housing for splitting said tubular core proximate said distal end;
c. first means attached to said housing for cutting said distal end of said tubular core aligned approximately perpendicularly to said means for splitting said distal end of said tubular core;
d. second means attached to said housing for cutting said tubular core proximate said distal end aligned in approximate parallel alignment to said first means for cutting said distal end of said tubular core;
e. said means for receiving said distal end of said tubular core comprising an input chute having an upper and a lower end; and
f. an approximately vertical splitter blade slidable proximate to said lower end of said input chute.

10. The device of claim 9 wherein said first means for cutting said distal end of said tubular core comprises a travelling blade aligned approximately perpendicularly to said splitter blade.

11. The device of claim 10 wherein said second means for cutting said tubular core proximate said distal end comprises a stationary blade aligned in approximate parallel alignment to said travelling blade.

12. A device for cutting a tubular core having a proximal and distal end into pieces, said device comprising:
a. a housing;
b. means attached to said housing for receiving said distal end of said tubular core;
b. means attached to said housing for splitting said tubular core proximate said distal end;
c. first means attached to said housing for cutting said distal end of said tubular core aligned approximately perpendicularly to said means for splitting said distal end of said tubular core;
d. second means attached to said housing for cutting said tubular core proximate said distal end aligned in approximate parallel alignment to said first means for cutting said distal end of said tubular core; and
e. means attached to said housing for sequentially moving said first means attached for cutting said distal end of said tubular core and said means for splitting said distal end of said tubular core into said tubular core and then moving said means for receiving said distal end of said tubular core and said distal end of said tubular core into said second means for cutting said tubular core.

13. The device of claim 12 wherein said means for sequentially moving said first means attached for cutting said distal end of said tubular core and said means for splitting said distal end of said tubular core into said tubular core and then moving said means for receiving said distal end of said tubular core and said distal end of said tubular core into said second means for cutting said tubular core comprises a piston.

14. The device of claim 13 wherein said means for discharging said stored pieces comprises an output chute.

15. The device of claim 14 wherein said means for pushing said stored pieces toward said means for discharging said stored pieces comprises a ram attached to said piston.

16. A device for cutting a tubular core having a proximal and distal end into pieces, said device comprising:
a. a housing;
b. means attached to said housing for receiving said distal end of said tubular core;
b. means attached to said housing for splitting said tubular core proximate said distal end;
c. first means attached to said housing for cutting said distal end of said tubular core aligned approximately perpendicularly to said means for splitting said distal end of said tubular core;
d. second means attached to said housing for cutting said tubular core proximate said distal end aligned in approximate parallel alignment to said first means for cutting said distal end of said tubular core;
e. means attached to said housing for discharging said stored pieces; and
f. means for preventing back flow of said stored pieces away from said means for discharging said stored pieces attached to said means for storing said pieces of said tubular core.

17. The device of claim 16 wherein said means for preventing back flow of said stored pieces comprises back feed dogs.

18. A device for cutting a tubular core having a proximal and distal end into pieces, said device comprising:
a. a housing;
b. means attached to said housing for receiving said distal end of said tubular core;
c. means attached to said housing for splitting said tubular core proximate said distal end;
d. first means attached to said housing for cutting said distal end of said tubular core aligned approximately perpendicularly to said means for splitting said distal end of said tubular core;
e. second means attached to said housing for cutting said tubular core proximate said distal end aligned in approximate parallel alignment to said first means for cutting said distal end of said tubular core;
f. means attached to said housing for sequentially moving said first means attached for cutting said distal end of said tubular core and said means for splitting said distal end of said tubular core into said tubular core and then moving said means for receiving said distal end of said tubular core and said distal end of said tubular core into said second means for cutting said tubular core;
g. means attached to said housing for storing said pieces of said tubular core;
h. means attached to said housing for discharging said stored pieces;
i. means attached to said housing for pushing said stored pieces toward said means for discharging said stored pieces;
j. said device being powered by electricity;
k. means attached to said means for receiving said distal end of said tubular core for turning on said electricity only when a core in said means for receiving said distal end of said tubular core; and
l. means for preventing back flow of said stored pieces away from said means for discharging said stored pieces attached to said means for storing said pieces of said tubular core.

19. A device for cutting a tubular core having a proximal and distal end into pieces, said device comprising:
a. a housing having an upper side and a lower side;

b. an input chute having an upper and a lower end attached to said upper side of said housing for receiving said distal end of said tubular core;

c. an approximately vertical splitter blade slidable proximate to said lower end of said input chute for splitting said tubular core proximate said distal end;

d. a travelling blade aligned approximately perpendicularly to said splitter blade for cutting said distal end of said tubular core aligned approximately perpendicularly to said means for splitting said distal end of said tubular core; and e. a stationary blade aligned in approximate parallel alignment to said travelling blade for cutting said tubular core proximate said distal end aligned in approximate parallel alignment to said travelling blade.

20. A device for cutting a tubular core having a proximal and distal end into pieces, said device comprising:

a. a housing having an upper side and a lower side;

b. an input chute having an upper and a lower end attached to said upper side of said housing for receiving said distal end of said tubular core;

c. an approximately vertical splitter blade slidable proximate to said lower end of said input chute for splitting said tubular core proximate said distal end;

d. a travelling blade aligned approximately perpendicularly to said splitter blade for cutting said distal end of said tubular core aligned approximately perpendicularly to said means for splitting said distal end of said tubular core;

e. a stationary blade aligned in approximate parallel alignment to said travelling blade for cutting said tubular core proximate said distal end aligned in approximate parallel alignment to said travelling blade;

f. a piston for sequentially moving said travelling blade and said splitter blade and then moving said input chute and said distal end of said tubular core into said stationary blade;

g. said housing having a storage area for said pieces proximate said travelling blade;

h. an output chute attached to said first side of said housing;

i. plural back feed dogs for preventing back flow of said stored pieces away from said output chute; and j. a ram for pushing said stored pieces toward said output chute attached to said piston.

21. A device for cutting an object into pieces comprising:

a. a housing;

b. means attached to said housing for receiving said distal end of said tubular core;

c. means attached to said housing for splitting said tubular core proximate said distal end;

d. first means attached to said housing for cutting said distal end of said tubular core aligned approximately perpendicularly to said means for splitting said distal end of said tubular core;

e. second means attached to said housing for cutting said tubular core proximate said distal end aligned in approximate parallel alignment to said first means for cutting said distal end of said tubular core;

f. means for storing said pieces attached to said housing;

g. means for discharging said stored pieces; and h. means attached to said housing for pushing said stored pieces toward said means for discharging said stored pieces.

22. The device of claim 21 further comprising means attached to said housing for storing said pieces of said tubular core.

23. The device of claim 22 further comprising means attached to said housing for discharging said stored pieces.

24. The device of claim 22 wherein said means for storing said pieces of said tubular core comprises a storage area in said housing.

25. The device of claim 22 further comprising means for preventing back flow of said stored pieces away from said means for discharging said stored pieces attached to said means for storing said pieces of said tubular core.

26. The device of claim 21 wherein said means for receiving said distal end of said tubular core comprising an input chute having an upper and a lower end.

27. The device of claim 21 further comprising:

a. said device being powered by electricity; and b. means attached to said means for receiving said distal end of said tubular core for turning on said electricity only when a core in said means for receiving said distal end of said tubular core.

28. The device of claim 24 wherein said means for turning on said electricity only when a core in said means for receiving said distal end of said tubular core comprises a safety switch.

* * * * *